US005139583A

United States Patent [19]

Kawabata et al.

[11] Patent Number: 5,139,583

[45] Date of Patent: Aug. 18, 1992

[54] GRAPHITE PRECIPITATED HOT-ROLLED STEEL PLATE HAVING EXCELLENT BENDING WORKABILITY AND HARDENABILITY AND METHOD THEREFOR

[75] Inventors: Yoshikazu Kawabata; Masahiko Morita; Fusao Togashi, all of Chiba, Japan

[73] Assignee: Kawasaki Steel Corporation, Hyogo, Japan

[21] Appl. No.: 822,649

[22] Filed: Jan. 21, 1992

[51] Int. Cl.[5] ..... C22C 38/04; C21D 8/02

[52] U.S. Cl. ..... 148/653; 148/330

[58] Field of Search ..... 148/330, 12 F, 12.1; 420/121, 128

[56] References Cited

U.S. PATENT DOCUMENTS 3,660,174 5/1972 Jakenberg ..... 148/12 F 4,435,226 3/1984 Neuhäuser et al. ..... 148/330

4,491,476 1/1985 Tada et al. ..... 420/121

FOREIGN PATENT DOCUMENTS 5442326 4/1979 Japan .

8832164 12/1988 Japan .

*Primary Examiner*—Deborah Yee

*Attorney, Agent, or Firm*—Dvorak and Traub

[57] ABSTRACT

A graphite precipitated hot-rolled steel plate having excellent bending workability and hardenability, the graphite precipitated hot-rolled steel plate comprising: 0.1 to 1.0% (by weight percent) C; 0.05 to 1.0% (by weight percent) Mn; 3 to 50 ppm B; 200 ppm or less N the quantity of which is three times or more the quantity of B; and a balance of Fe and unavoidable impurities, wherein graphite the diameter of which is 5 μm or less is precipitated in such a manner that distance between graphite particles is at a distance of 5 μm or longer.

6 Claims, 1 Drawing Sheet

GRAPHITE PRECIPITATED HOT-ROLLED STEEL PLATE HAVING EXCELLENT BENDING WORKABILITY AND HARDENABILITY AND METHOD THEREFOR

BACKGROUND OF THE INVENTION

1. Field of the Invention

The present invention relates to a graphite precipitated hot-rolled steel plate having excellent bending workability and hardenability and a manufacturing method therefor. More particularly, the present invention relates to a graphite precipitated hot-rolled steel plate (hereinafter called a "graphite steel plate") having excellent bending workability and enabling satisfactory strength and wear resistance which is obtained by hardening performed after machining has been performed and a manufacturing method therefor.

2. Related Art Statement

A major portion of mechanical parts are given strength and wear resistance by a heat treatment performed after the forming work. In order to meet the strength and the wear resistance requirements realized after completion of the heat treatment, high carbon steel has been used. However, since much of the production of steel has been changed from hot forming to cold forming in recent years in order to improve the manufacturing yield and to suppress decarbonization, there has been a need to improve the cold workability of the conventional high carbon steel. To this end, inventors of the present invention have found that the workability can be improved by making the microstructure of high carbon steel to have a graphite precipitated in the ferrite. The inventors also found that it is necessary to fine down the graphite present in the ferrite in order to improve the hardenability of the steel. They also found that an addition of B is significantly effective and beneficial. Therefore, a technology has been disclosed in Japanese Patent Laid-Open No. 2-107742 and Japanese Patent Laid-Open No. 2-111842, which enables a hot-rolled steel plate, which has excellent bending workability and heat hardenability, to be manufactured by subjecting the steel containing B to an annealing process after the hot rolling step.

The above-described disclosures teach how graphite particles can be significantly finely precipitated in comparison to the conventional technology. These disclosures establish that cold workability superior to that obtainable from conventional carbide-spheroidizing annealing (steel having spheroidal carbide) can be realized while having hardenability corresponding to the quantity of carbon.

However, steel of the type manufactured by a method according to the above-described prior art encounters a problem in a case where it is formed as a hot-rolled steel plate, and in particular, in a case where it is subjected to bending work. The reason for this was researched, and it was found that the distance between graphite particles is too short although the graphite particles are fined down or small. As a result, the graphite particles act as if they are large deposits and thereby they serve as the initiation point or the propagation route of the cracks which will take place at the time of the bending work.

SUMMARY OF THE INVENTION

Accordingly, an object of the present invention is to provide a hot-rolled graphite steel plate having excellent hardenability and workability, and more particularly, excellent bending workability.

Another object of the present invention is to provide a method of manufacturing steel of the above-described type.

According to one aspect of the present invention, there is provided a graphite precipitated hot-rolled steel plate having excellent bending workability and hardenability, said graphite precipitated hot-rolled steel plate comprising: 0.1 to 1.0% (by weight percent) C; 0.05 to 1.0% (by weight percent) Mn; 3 to 50 ppm B; 200 ppm or less N the quantity of which is three times or more the quantity of B; and a balance of Fe and unavoidable impurities, or further comprising any one of 3.0% or less Si, 3.0% or less Ni, 1.0% or less Al and 1.0% or less Cu, wherein the graphite has a diameter of which is 5 μm or less is precipitated in such a manner that distance between graphite particles is at a distance of 5 μm or longer.

According to another aspect of the present invention, there is provided a method of manufacturing a graphite precipitated hot-rolled steel plate having excellent bending workability and hardenability and comprising the steps of: hot rolling the steel the chemical composition of which comprises:

0.1 to 1.0% (by weight percent) C;
0.05 to 1.0% (by weight percent) Mn;
3 to 50 ppm B;
200 ppm or less N the quantity of which is three times or more the quantity of B; and
a balance of Fe and unavoidable impurities,
wherein graphite the diameter of which is 5μm or less, is precipitated in such a manner that distance between graphite particles is at a distance of 5 μm or longer, at 930° to 1000° C. at a rolling reduction of 10% or more; and annealing said steel at a temperature from 500° C. to $Ac_1$.

Other and further objects, features and advantages of the invention will be appear more fully from the following description.

DESCRIPTION OF THE PREFERRED EMBODIMENTS

Figure 1:
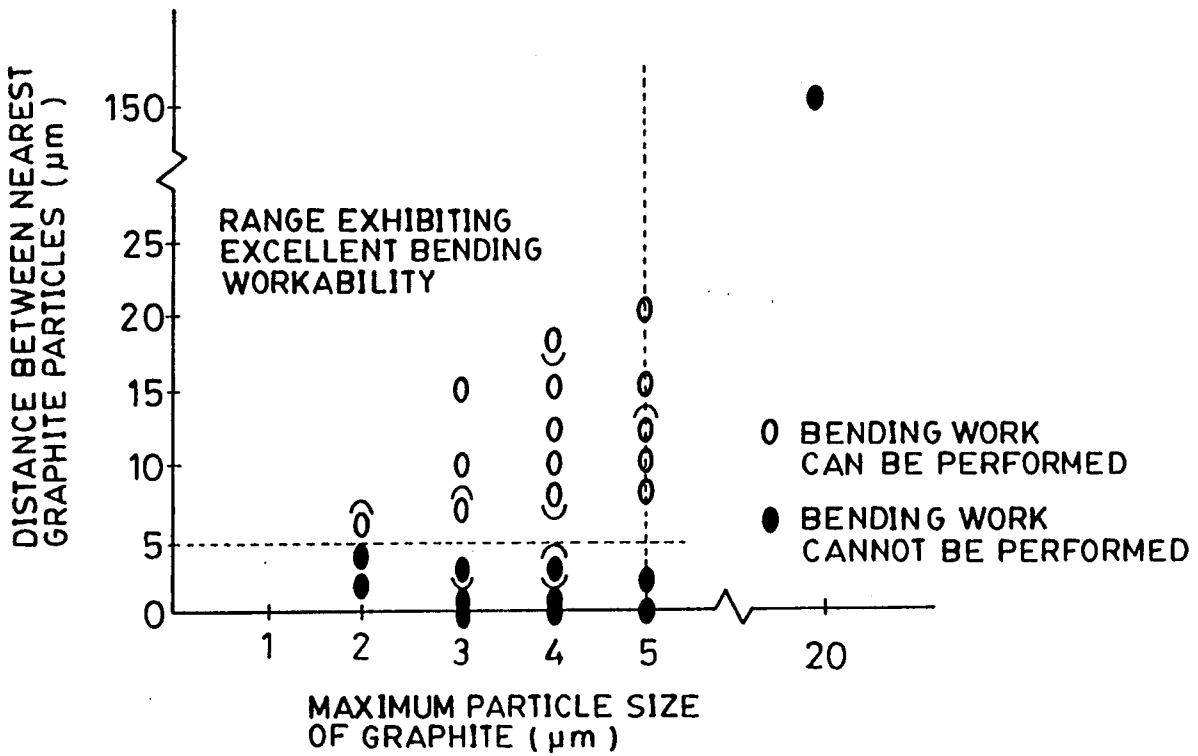
FIG. 1, the single Figure of drawings, is a graph which illustrates the relationship between the maximum particle size of graphite particles and the distance between nearest graphite particles.

The structure and the operation of the present invention will be first described.

The inventors have studied the way of improving the bending workability of steel of a type having the structure in which graphite is precipitated in the ferrite thereof. As a result, as shown in FIG. 1 which illustrates the relationship between the maximum particle size of the graphite and the distance between the nearest graphite particles, it was found to be necessary to make the particle size of the graphite in the ferrite 5 μm or less and as well as to make the distance between the nearest graphite particles 5 μm or longer, in order to improve the bending workability in comparison to that of the conventional steel. According to the specification of the above-described Japanese Patent Laid-Open No. 2-107742 filed by the inventors of the present invention, it was disclosed that the number of the graphite particles can be increased to 1000 pieces/$mm^2$ or more by adding B, that is, the particle size of the graphite can be made to be 5 μm or less. However, it was not previously known that to improve bending workability, it is necessary to distribute the graphite particles in such a manner that the distance between the particles is 5 μm or longer.

As a result of a further research and development by the inventors, it was found that the quantities of B and N to be added and the finishing conditions should be controlled. Thus, the present invention was established. Specifically, it was found that it is effective to make the quantity of N to be added to the steel to be three times or more of the quantity of B. It was also found that it is preferable that the same quantity of N is made to be 200 ppm or less. Furthermore, it was found that it is preferable that annealing be performed in a temperature range between 500° C. and $Ac_1$, after rolling has been performed under the condition in which the rolling reduction at the rolling operation is 10% or more. Supplemental to the above-described procedure, the following factors are relevant:

(1) In graphite steel to which B is added, graphite precipitates, having BN as a nuclear site for precipitation, that is, the precipitation of graphite corresponds to the distribution of BN.

(2) On the other hand, BN ordinarily precipitates by thousands particles/$mm^2$ and thereby the size of each graphite particle is 5 μm or less when the quantity of C is 1.0% or less according to the present invention.

(3) Although the precipitation of BN occurs at 1000° C. or lower in a case where steel is rolled at a reduction rate of 10% or more, the diffusion is performed at a high speed and the precipitation occurs with a small driving force when the temperature is 930° C. or higher. Therefore, the size of each particle is enlarged, but the number of the precipitates becomes small. That is, the nearest distance between BN particles becomes longer. On the other hand, when the temperature is lower than 930° C., the diffusion is performed at a low speed and thereby the precipitation is driven by a larger force. Therefore, the size of each particles is reduced but the number of the particles increases. That is, the distance between the BN particles becomes smaller.

(4) As a result, by performing rolling at a rolling reduction of 10% or more at 930° to 1000° C. and by causing the precipitation of BN to be completed in the above-described range, the distance between the BN particles can be made to be long and graphite particles, having BN as a nuclear site for precipitation, can be distributed apart from each other. Therefore, also the bending workability of the steel can be improved. That is, the scope of the present invention gives a condition in which the overall portion of added B is precipitated in the temperature range in which BN is distributed properly away from one another. However, if the quantity of N, which is not precipitated as BN, is increased, N is distributed in the cementite and stabilizes the cementite, requiring a long annealing time for promoting graphitization, in order to improve bending workability. Therefore, N content must be limited to not more than 200 ppm.

The reason why the composition of each component is limited according to the present invention will now be described.

C: C is added in order to improve the strength and wear resistance after heat treatment. If the quantity of C is less than 0.1%, satisfactorily improved strength and wear resistance cannot be obtained. If the same exceeds 1.0%, hot rolling becomes excessively difficult. Therefore, the range of the quantity of C is determined in a range from 0.1% to 1.0%.

Mn: Mn is added in order to fix S contained in the steel to make the steel to be clean, and as well as to maintain the hardenability. However, if the quantity of Mn is less than 0.05%, the above-described two effects become unsatisfactory. Therefore, the smallest quantity of Mn is determined to be 0.05%. If the quantity of Mn exceeds 1.0%, forming of graphite cannot satisfactorily proceed. The largest quantity of Mn is determined to be 1.0%. Furthermore, since Mn is an element acting to hinder the graphitization process, the same cannot satisfactorily proceed if the quantity of Mn exceeds 0.3%. Therefore, it is preferable that Si, Ni, Al and Cu be added in order to cause the graphitization process to proceed satisfactorily.

B and N: Since B is precipitated in the form of BN it is necessary to add B to make the diameter of each of the graphite particle to be 5 μm or less. If the quantity of B is less than 3 ppm, the above-described effect cannot be obtained. On the other hand, if the same exceeds 50 ppm, the effect is saturated and on that ground, the smallest quantity is limited to 3 ppm and the largest quantity is limited to 50 ppm. If the quantity of N is, as shown in Table 2, a value which is smaller than three times or less of the quantity of B, the graphite particles will undesirably be connected to one another even if proper rolling is performed. Therefore, the bending workability will deteriorate as shown in Table 4. As a result, the quantity of N is determined to be three times or more the quantity of B.

Si, Ni, Al and Cu: Since these elements are graphite forming accelerating elements and as well as steel-strengthening elements acting as solid-solution to the steel matrix, each of the above-described elements is added by a proper quantity at need. However, if any of the above-described elements is added by a quantity larger than the scope of the present invention, the above-described graphitization effect and the steel strengthening by solid-solution effects are saturated. Therefore, the upper limits of the above-described elements to be added respectively are determined as follows: Si: 3.0% or less, Ni: 3.0% or less, Al: 1.0% or less and Cu: 1.0% or less.

A proper quantity of Co, Mo, Cr, Ca or Rem (Rare Earth Metal) may be added within the scope of the present invention. If the rolling and heat treatment conditions and the chemical composition of the steel meet the scope of the present invention, a structure in which graphite, the diameter of which is 3 μm or less, is precipitated in the ferrite, can be realized by properly performing rolling and annealing. Therefore, steel having excellent bending workability can be manufactured. The rolling conditions give effects to the distribution of BN, which functions as the graphite precipitation site, and the BN thereby affects the graphite distribution. If the rolling temperature is, as shown in Table 5, 930° C. or lower, the graphite particles undesirably are connected to one another when they are precipitated. Therefore, the bending workability will be deteriorated. If the rolling temperature is 930° C. or higher, the effect cannot be particularly improved in a case where the rolling reduction is 10% or more. That is, in order to perform an excellent bending work, it is preferable that the rolling temperature be made to be 930° to 1000° C. and the rolling reduction be made to be 10% or more.

However, the rolling operation may be performed under other conditions arranged in addition to the rolling operation performed under the above-described conditions. For example, it is possible that the sequence can be arranged in which rolling at a rolling reduction of 80% is performed at 1100° C., rolling at a rolling reduction of 30% is performed at 930° to 1000° C. is performed and rolling at a rolling reduction of 80% is performed at a temperature lower than the above-described temperature.

The reason why the annealing conditions are limited according to the present invention will now be described.

If the annealing temperature is higher than the $Ac_1$ temperature level, an undesirable austenite is generated at the time of the heating process, causing pearlite to be generated after the annealing operation. As a result, desired softening of steel cannot be obtained. Furthermore, if the annealing temperature is lower than 300° C., forming of graphite cannot satisfactorily be performed. Therefore, the annealing temperature is allowed to range from 500° C. to $Ac_1$ temperature. In order to quickly complete forming of the graphite, it is preferable that the temperature be made to be immediately below the $Ac_1$ temperature. Although the annealing time is determined depending upon the desired softening of steel, it is preferable that the same be one hour or longer because graphitization cannot proceed satisfactorily if the annealing time is shorter than one hour. However, it is possible that the annealing temperature is maintained at $Ac_1$ to $Ac_3$ temperature for a proper time before the above-described treatment in order to accelerate the spheroidizing of the cementite.

The steel, having the above-described composition, melted in a converter or an electric furnace, rolled under the above-described rolling conditions, and subjected to annealing. As a result, a graphite-precipitated structure, the diameter of which is 5 μm or less and in which the distance between the nearest graphite particles is 5 μm or longer, is precipitated in the steel, can be realized. Therefore, it is possible to obtain a flexible steel plate having excellent bending workability and possessing similar degree of heat treatment facility to that of steel material subjected to a sphere forming treatment and containing C by the same quantity. Furthermore, the steel plate according to the present invention has excellent drawing and flange-forming facilities. In addition, excellent free-cutting characteristics can be realized due to the chip-break effect caused from the precipitated graphite. Furthermore, a steel plate having satisfactory damping characteristics can be obtained due to the difference between the elastic coefficient of the graphite and that of the ferrite.

Examples

Examples of the present invention will now be described.

First, the method of carrying out experiments to which samples are subjected and symbols shown in tables will now be described.

(1) Evaluation of the Structure

Steel samples, having the chemical compositions shown in Table 2, were obtained. The samples were rolled and annealed to cause 80% or more of the contained C to be precipitated as graphite. Test pieces for microscopic evaluations were cut out of the samples. The test pieces, which were not etched, were observed at a magnification of 400 times or more by using an optical microscope. The evaluation was made in such a manner that a case, in which the distance between the nearest graphite particles was 5 μm or longer and as well as the diameter of the graphite particles was 5 μm or under, was evaluated as having a good structure designated by o and other cases were evaluated as a defective structure X. However, cases in each of which graphite could not be formed by 80% or more by annealing were evaluated as a defective structure designated by X regardless of the graphite distribution.

According to the present invention, the "distance between the nearest graphite particles" is defined as the shortest distance between the facing surfaces of the nearest graphite particles observed by a microscope under the same conditions of observing the graphite particles as the above-described observation conditions.

(2) Evaluation of "bending workability"

Steel ingot having chemical compositions shown in Table 2 were obtained by melting. Thus obtained ingots were rolled and annealed. Samples, the thickness of each of which was 4.0 mm, obtained by cutting them in a direction perpendicular to the direction of rolling. The samples were subjected to a close-contact bending test in accordance with JIS. The evaluation was made in such a manner that a case in which bending could be performed is evaluated as excellent designated by o and a case in which bending could not be performed is evaluated as defective designated by X.

(3) Evaluation of "hardenability"

Steel samples having the chemical compositions as shown in Table 2 were melted, rolled and annealed. The samples were then held at 870° C. for 12 minutes and were quenched with oil, the temperature of which was 100° C. The evaluation was made in such a manner that a case in which hardness, which was determined depending upon the quantity of C shown in Table 1, was realized was evaluated as excellent hardenability designated by o and other cases were evaluated as defective hardenability designated by X.

TABLE 1

| Quantity of C added (%) | Quenched Hardness (Hv) |
|---|---|
| 0.1 to 0.2 | 330 |
| 0.2 to 0.3 | 400 |
| 0.3 to 0.4 | 520 |
| 0.4 to 0.5 | 620 |
| 0.5 to 0.7 | 690 |
| 0.7 or more | 770 |

The present invention will now be described with reference to examples.

Steel, the chemical compositions of which were shown in Table 2, was melted in the converter. Then, for obtaining samples, the steel was rolled and annealed under the conditions shown in Table 3. The evaluation results of the samples are shown in Table 4. As can be clearly seen from Table 4, the samples, the chemical composition of each of which met the range according to the present invention, showed both satisfactory maximum graphite particle size and nearest graphite distance. Furthermore, they exhibited excellent bending workability and hardenability. On the other hand, the following comparative example samples showed defective bending workability because graphitization could not proceed satisfactorily: comparative example sample No. 21 which contained no Si, Ni, Al and Cu and contained Mn by a quantity exceeded 0.3%; comparative example sample No. 22 which contained B by less than 3 ppm and comparative example sample No. 27 which contained N by more than 200 ppm.

Comparative example sample Nos. 6 and 7 each of which contained N by a quantity which is less than three times the quantity of B showed a distance between the nearest graphite particles of 5 μm or shorter. Therefore, the bending workability of each of them was unsatisfactory level.

Sample No. 4, the chemical composition of which met the range according to the present invention, was produced by hot rolling a mother material at 910° to 1000° C. at a reduction rate of 0 to 50%. Then, it was annealed under conditions shown in Table 3. The characteristics of the samples are shown in Table 5. As can be clearly seen from Table 5, the samples which had been rolled under the conditions according to the present invention showed both satisfactory maximum graphite particle size and nearest graphite distance. Furthermore, they exhibited excellent bending workability and hardenability. On the other hand, the comparative example samples which had been subjected to rolling under the conditions deviated from the present invention showed a length between the nearest graphite particles of shorter than 5 μm. Therefore, they showed unsatisfactory bending workability.

As described above, the steel according to the present invention contains C, Mn or C, Mn, Si, Ni, Al, Cu and B by a proper quantity in such a manner that the quantity of N is three times B content. Furthermore, the steel which contains the above-described elements is caused to have a structure in which graphite the diameter of which is 5 μm or less is precipitated in the ferrite matrix in such a manner that the graphite particles are not connected to one another and as well as they are positioned at a distance of 5 μm or longer.

Therefore, the steel according to the present invention is soft in quality and rich in bending workability when compared to the conventional high carbon steel having spheroid structure with carbide, because soft graphite particles precipitates exist in ferrite matrix, instead of cementite which is hard. Furthermore, the steel of this invention can be subjected to a severe bending work because graphite particles precipitates away from one another. Therefore, it can be subjected to severe processing such as a bending work. Furthermore, since the graphite form is fine, heat treatment, especially quenching is applied after press forming. If the steel according to the present invention is used as material for manufacturing parts having a complicated shape, carburization or nitrization process, which are conventionally needed to low carbon steel, can be eliminated. As a result, the productivity can be improved and the cost can be reduced.

Although the invention has been described in its preferred form with a certain degree of particularly, it is understood that the present disclosure of the preferred form has been changed in the details of construction and the combination and arrangement of parts may resorted to without departing from the spirit and the scope of the invention as hereinafter claimed.

TABLE 2

| Sample No. | Chemical Composition (wt %) | | | | | | | | | | |
|---|---|---|---|---|---|---|---|---|---|---|---|
| | C | Mn | Si | Ni | Al | Cu | P | S | B | N | B/N (ppm) |
| 1 | 0.59 | 0.79 | 1.64 | <0.01 | 0.02 | <0.01 | 0.008 | 0.002 | 0.0009 | 0.0031 | 0.29 |
| 2 | 0.55 | 0.10 | <0.04 | 0.50 | <0.005 | <0.01 | 0.006 | 0.001 | 0.0003 | 0.0010 | 0.10 |
| 3 | 0.54 | 0.09 | <0.04 | 0.55 | <0.005 | <0.01 | 0.008 | 0.002 | 0.0003 | 0.0012 | 0.25 |
| 4 | 0.58 | 0.09 | <0.04 | 0.52 | <0.005 | <0.01 | 0.007 | 0.002 | 0.0011 | 0.0035 | 0.31 |
| 5 | 0.53 | 0.09 | <0.04 | 0.55 | <0.005 | <0.01 | 0.006 | 0.001 | 0.0015 | 0.0050 | 0.30 |
| 6 | 0.60 | 0.11 | <0.04 | 0.55 | <0.005 | <0.01 | 0.007 | 0.003 | 0.0010 | 0.0024 | 0.42 |
| 7 | 0.55 | 0.09 | <0.04 | 0.53 | <0.005 | <0.01 | 0.006 | 0.003 | 0.0015 | 0.0021 | 0.71 |
| 8 | 0.53 | 0.10 | <0.04 | 0.55 | <0.005 | <0.01 | 0.007 | 0.002 | 0.0011 | 0.0050 | 0.22 |
| 9 | 0.61 | 0.80 | 1.65 | 0.13 | <0.005 | <0.01 | 0.007 | 0.003 | 0.0012 | 0.0036 | 0.33 |
| 10 | 0.10 | 0.05 | 3.00 | <0.01 | 0.31 | <0.01 | 0.005 | 0.001 | 0.0006 | 0.0025 | 0.24 |
| 11 | 0.61 | 0.13 | <0.04 | 1.00 | <0.005 | 0.98 | 0.008 | 0.001 | 0.0010 | 0.0032 | 0.31 |
| 12 | 0.50 | 0.78 | 0.17 | <0.01 | <0.005 | <0.01 | 0.013 | 0.005 | 0.0013 | 0.0042 | 0.31 |
| 13 | 0.31 | 0.09 | <0.04 | <0.01 | 0.98 | <0.01 | 0.010 | 0.003 | 0.0003 | 0.0020 | 0.15 |
| 14 | 0.60 | 0.25 | 0.10 | <0.01 | <0.005 | 1.00 | 0.003 | 0.001 | 0.0007 | 0.0021 | 0.33 |
| 15 | 0.59 | 0.10 | <0.04 | 3.00 | <0.005 | 0.95 | 0.005 | 0.002 | 0.0009 | 0.0040 | 0.23 |
| 16 | 0.83 | 0.85 | <0.04 | 0.95 | 0.98 | <0.01 | 0.007 | 0.003 | 0.0012 | 0.0037 | 0.32 |
| 17 | 0.88 | 0.25 | <0.04 | 0.45 | <0.005 | 0.02 | 0.005 | 0.003 | 0.0005 | 0.0039 | 0.13 |
| 18 | 0.60 | 0.10 | 0.31 | 0.55 | 0.03 | 0.98 | 0.003 | 0.001 | 0.0014 | 0.0042 | 0.33 |
| 19 | 0.10 | 0.05 | <0.04 | <0.01 | <0.005 | <0.01 | 0.005 | 0.001 | 0.005 | 0.0025 | 0.20 |
| 20 | 0.60 | 0.30 | <0.04 | <0.01 | <0.005 | <0.01 | 0.007 | 0.001 | 0.0015 | 0.0048 | 0.31 |
| 21 | 0.40 | 0.40 | <0.04 | <0.01 | <0.005 | <0.01 | 0.006 | 0.001 | 0.0012 | 0.0039 | 0.31 |
| 22 | 0.54 | 0.09 | <0.04 | 0.52 | <0.005 | <0.01 | 0.007 | 0.001 | <0.0002 | 0.0030 | — |
| 23 | 0.52 | 0.09 | <0.04 | 0.55 | 0.02 | <0.01 | 0.007 | 0.002 | 0.0050 | 0.0150 | 0.33 |
| 24 | 0.54 | 1.00 | <0.04 | 0.60 | <0.005 | <0.01 | 0.006 | 0.001 | 0.0032 | 0.0102 | 0.31 |
| 25 | 0.54 | 0.09 | <0.04 | 0.57 | <0.005 | <0.01 | 0.008 | 0.003 | 0.0010 | 0.0069 | 0.14 |
| 26 | 0.53 | 1.00 | <0.04 | 0.59 | <0.005 | <0.01 | 0.007 | 0.005 | 0.0050 | 0.0200 | 0.25 |
| 27 | 0.54 | 1.00 | <0.04 | 0.57 | <0.005 | <0.01 | 0.008 | 0.004 | 0.0050 | 0.0230 | 0.22 |

(Note) In Table 2, samples No. 6, 7, 21, 22 and 27 are comparative examples and the remainder are examples.

TABLE 3

| Sample No. | Acl Temperature (°C.) | Rolling Work Temperature (°C.) | Rolling Reduction (%) | Annealing Condition (°C. × h) |
|---|---|---|---|---|
| 1 | 762 | 950 | 20 | 700 × 40 |
| 2 | 714 | 970 | 30 | 700 × 40 |
| 3 | 721 | 970 | 30 | 700 × 40 |
| 4 | 713 | 910~1000 | 0~50 | 700 × 40 |
| 5 | 713 | 940 | 10 | 700 × 40 |
| 6 | 713 | 930 | 40 | 700 × 40 |
| 7 | 714 | 930 | 40 | 700 × 40 |
| 8 | 714 | 930 | 40 | 700 × 100 |
| 9 | 760 | 930 | 40 | 700 × 40 |
| 10 | 810 | 990 | 10 | 700 × 40 |
| 11 | 705 | 970 | 30 | 780 × 20 |
| 12 | 720 | 970 | 30 | 700 × 40 |
| 13 | 722 | 970 | 40 | 700 × 40 |
| 14 | 723 | 990 | 40 | 700 × 40 |

TABLE 3-continued

| Sample No. | Acl Temperature (°C.) | Rolling Work Temperature (°C.) | Rolling Reduction (%) | Annealing Condition (°C. × h) |
|---|---|---|---|---|
| 15 | 670 | 970 | 30 | 600 × 40 |
| 16 | 700 | 970 | 40 | 600 × 80 |
| 17 | 713 | 980 | 40 | 600 × 80 |
| 18 | 722 | 970 | 40 | 720 × 20 |
| 19 | 722 | 930 | 20 | 720 × 40 |
| 20 | 720 | 950 | 50 | 700 × 40 |
| 21 | 719 | 930 | 50 | 700 × 40 |
| 22 | 714 | 950 | 30 | 700 × 60 |
| 23 | 711 | 950 | 50 | 680 × 100 |

TABLE 3-continued

| Sample No. | Acl Temperature (°C.) | Rolling Work Temperature (°C.) | Rolling Reduction (%) | Annealing Condition (°C. × h) |
|---|---|---|---|---|
| 24 | 713 | 970 | 50 | 680 × 100 |
| 25 | 713 | 830 | 20 | 700 × 60 |
| 26 | 715 | 950 | 50 | 680 × 100 |
| 27 | 713 | 960 | 50 | 680 × 100 |

TABLE 4

| Sample No. | Microstructure: Maximum Particle Size of Graphite (μm) | Microstructure: Distance between Nearest Graphite Particles (μm) | Bending Workability | Quenched Hardness (Hv) | Graphitization Rate (%) |
|---|---|---|---|---|---|
| 1 | 3 | 10 | ○ | 740 | 90 |
| 2 | 5 | 10 | ○ | 700 | 92 |
| 3 | 5 | 8 | ○ | 700 | 88 |
| 4 | Table 5 | Table 5 | Table 5 | 700~720 | 90 |
| 5 | 2 | 7 | ○ | 705 | 95 |
| 6 | 5 | 0 | X | 710 | 95 |
| 7 | 4 | 2 | X | 710 | 48 |
| 8 | 5 | 20 | ○ | 700 | 83 |
| 9 | 3 | 8 | ○ | 730 | 92 |
| 10 | 5 | 15 | ○ | 400 | 95 |
| 11 | 5 | 12 | ○ | 740 | 98 |
| 12 | 5 | 15 | ○ | 700 | 97 |
| 13 | 5 | 15 | ○ | 580 | 90 |
| 14 | 5 | 13 | ○ | 740 | 90 |
| 15 | 5 | 12 | ○ | 720 | 88 |
| 16 | 5 | 15 | ○ | 800 | 85 |
| 17 | 5 | 10 | ○ | 800 | 90 |
| 18 | 5 | 10 | ○ | 730 | 90 |
| 19 | 2 | 6 | ○ | 340 | 82 |
| 20 | 4 | 17 | ○ | 700 | 90 |
| 21 | 4 | 18 | X | 670 | 50 |
| 22 | 20 | 150 | X | 695 | 20 |
| 23 | 4 | 20 | ○ | 705 | 82 |
| 24 | 4 | 22 | ○ | 700 | 88 |
| 25 | 4 | 20 | ○ | 704 | 92 |
| 26 | 3 | 20 | ○ | 700 | 80 |
| 27 | 2 | 20 | X | 710 | 70 |

TABLE 5

| Rolling Reduction (%) | Rolling Work Temperature (°C.) 910: Structure A | 910: Structure B | 910: Bending Workability | 920: Structure A | 920: Structure B | 920: Bending Workability | 930: Structure A | 930: Structure B | 930: Bending Workability | 940: Structure A | 940: Structure B | 940: Bending Workability |
|---|---|---|---|---|---|---|---|---|---|---|---|---|
| 50 | 3 | 2 | X | 4 | 4 | X | 4 | 9 | ○ | 4 | 10 | ○ |
| 40 | 4 | 3 | X | 4 | 3 | X | 4 | 7 | ○ | 4 | 12 | ○ |
| 30 | 3 | 2 | X | 2 | 4 | X | 4 | 8 | ○ | 3 | 10 | ○ |
| 20 | 2 | 2 | X | 3 | 3 | X | 3 | 8 | ○ | 4 | 10 | ○ |
| 10 | 3 | 1 | X | 4 | 3 | X | 3 | 7 | ○ | 4 | 8 | ○ |
| 5 | 3 | 0 | X | 3 | 1 | X | 4 | 2 | X | 4 | 1 | X |
| 0 | 3 | 0 | X | 3 | 0 | X | 4 | 0 | X | 4 | 0 | X |

| Rolling Reduction (%) | Rolling Work Temperature (°C.) 960: Structure A | 960: Structure B | 960: Bending Workability | 980: Structure A | 980: Structure B | 980: Bending Workability | 1000: Structure A | 1000: Structure B | 1000: Bending Workability |
|---|---|---|---|---|---|---|---|---|---|
| 50 | 4 | 12 | ○ | 4 | 15 | ○ | 5 | 13 | ○ |
| 40 | 3 | 15 | ○ | 5 | 12 | ○ | 5 | 10 | ○ |
| 30 | 5 | 12 | ○ | 4 | 10 | ○ | 5 | 15 | ○ |
| 20 | 3 | 7 | ○ | 5 | 15 | ○ | 5 | 12 | ○ |
| 10 | 4 | 8 | ○ | 5 | 10 | ○ | 5 | 10 | ○ |
| 5 | 5 | 0 | X | 4 | 3 | X | 5 | 0 | X |
| 0 | 3 | 1 | X | 5 | 0 | X | 5 | 2 | X |

(Note) Referring to Table 5, "structure" denotes microstructure, A denotes maximum diameter (μm) of graphite particles and B denotes the distance (μm) between nearest graphite particles.

What is claimed is:

1. A graphite precipitated hot-rolled steel plate having excellent bending workability and hardenability, said graphite precipitated hot-rolled steel plate comprising:

0.1 to 1.0% (by weight percent) C;

0.05 to 1.0% (by weight percent) Mn;

3 to 50 ppm B;

200 ppm or less N, the quantity of which is three times or more the quantity of B; and a balance of Fe and inevitable impurities, wherein graphite the diameter of which is 5 μm or less, is precipitated in such a manner that distance between graphite particles is at a distance of 5 μm or longer.

2. A graphite precipitated hot-rolled steel plate having excellent bending workability and hardenability according to claim 1 further comprising any one of 3.0% or less Si, 3.0% or less Ni, 1.0% or less Al and 1.0% or less Cu.

3. A graphite precipitated hot-rolled steel plate having excellent bending workability and hardenability, as claimed in claim 1, which is hot-rolled at 930° to 1000° C. at a rolling reduction of 10% or more before the same is annealed at a temperature from 500° C. to $Ac_1$.

4. A graphite precipitated hot-rolled steel plate having excellent bending workability and hardenability as claimed in claim 2, which is hot-rolled at 930° to 1000° C. at a rolling reduction of 10% or more before the same is annealed at a temperature from 500° C. to $Ac_1$.

5. A method of manufacturing a graphite precipitated hot-rolled steel plate comprising:

0.1 to 1.0% (by weight percent) C;

0.05 to 1.0% (by weight percent) Mn;

3 to 50 ppm B;

200 ppm or less N, the quantity of which is three times or more the quantity of B; and a balance of Fe and unavoidable impurities, wherein graphite the diameter of which is 5 μm or less, is precipitated in such a manner that distance between graphite particles is at a distance of 5 μm or longer, the method comprising the steps of:

hot rolling said steel at 930° to 1000° C. at a rolling reduction of 10% or more; and annealing said steel at a temperature from 500° C. to $Ac_1$.

6. A method of manufacturing a graphite precipitated hot-rolled steel plate, said graphite precipitated hot-rolled steel plate comprising:

0.1 to 1.0% (by weight percent) C;

0.05 to 1.0% (by weight percent) Mn;

3 to 50 ppm B;

200 ppm or less N, the quantity of which is three times or more the quantity of B; and a balance of Fe and unavoidable impurities, wherein graphite the diameter of which is 5 μm or less, is precipitated in such a manner that distance between graphite particles is at a distance of 5 μm or longer, and any one of 3.0% or less Si, 3.0% or less Ni, 1.0% or less Al and 1.0% or less Cu, the method comprising the steps of:

hot rolling said steel at 930° to 1000° C. at a rolling reduction of 10% or more; and annealing said steel at a temperature from 500° C. to $Ac_1$.

* * * * *